US006937259B2

(12) United States Patent
Sasaki et al.

(10) Patent No.: US 6,937,259 B2
(45) Date of Patent: Aug. 30, 2005

(54) IMAGE FORMING DEVICE AND RECORDING INTERMEDIATE BELT MOUNTING JIG

(75) Inventors: Kenji Sasaki, Kyoto (JP); Yoshihiro Yokoyama, Osaka (JP); Haruo Yamashita, Osaka (JP); Kazuyuki Takahashi, Osaka (JP); Tetsuya Morita, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 94 days.

(21) Appl. No.: 10/363,357

(22) PCT Filed: Sep. 3, 2001

(86) PCT No.: PCT/JP01/07654

§ 371 (c)(1),
(2), (4) Date: Jun. 19, 2003

(87) PCT Pub. No.: WO02/20273

PCT Pub. Date: Mar. 14, 2002

(65) Prior Publication Data

US 2004/0036758 A1 Feb. 26, 2004

(30) Foreign Application Priority Data

Sep. 4, 2000 (JP) ..... 2000-267832
Sep. 12, 2000 (JP) ..... 2000-277357

(51) Int. Cl.[7] ..... B41J 2/32; B41J 2/325
(52) U.S. Cl. ..... 347/171; 347/213
(58) Field of Search ..... 347/171–172, 347/175–176, 213, 215; 400/120.01, 120.02, 120.04, 120.16; 399/49, 60, 302, 162, 167

(56) References Cited

U.S. PATENT DOCUMENTS 5,512,986 A * 4/1996 Toyomura et al. ..... 399/60
5,708,467 A * 1/1998 Yoshikawa et al. ..... 347/213
6,658,221 B2 * 12/2003 Hama et al. ..... 399/49
6,704,037 B1 * 3/2004 Taguchi ..... 347/213

FOREIGN PATENT DOCUMENTS

| | | |
|---|---|---|
| JP | 64-090772 | 10/1987 |
| JP | 64-090772 | 4/1989 |
| JP | 05-301651 | 11/1993 |
| JP | 08-187887 | 7/1996 |
| JP | 2729992 | 9/1997 |
| JP | 2000-162891 | 6/2000 |

* cited by examiner

*Primary Examiner*—K. Feggins
(74) *Attorney, Agent, or Firm*—Renner, Otto, Boisselle & Sklar, LLP

(57) ABSTRACT

A recording intermediate belt 15 which is made endless so as to travels around a continuous path has image formation areas and non-image formation areas alternately provided on an outer surface thereof. Images of different colors are sequentially formed in the image formation areas by recording heads 21*b* through 23*b* respectively provided in first through third image formation sections 21 through 23. The recording heads 21*b* through 23*b* of the first through third image formation sections 21 through 23 are separated from each other by a distance which is greater than a length of an image formation area in a traveling direction of the recording intermediate belt 15. The recording heads 21*b* through 23*b* are each pressed onto the recording intermediate belt 15 in a non-image formation area immediately preceding an image formation area and starts an image formation operation. The image formation operation is stopped when the recording heads 21*b* through 23*b* each face a non-image formation area immediately subsequent to the image formation area. Thus, a clear full-color image can be formed with the image formed in each image formation section being free from color non-uniformity.

4 Claims, 11 Drawing Sheets

IMAGE FORMING DEVICE AND RECORDING INTERMEDIATE BELT MOUNTING JIG

TECHNICAL FIELD

The present invention relates to an image forming apparatus capable of forming a high quality full-color image on a recording paper, which is a plain paper, at a high speed, and a recording intermediate belt mounting jig usable for the image forming apparatus.

BACKGROUND ART

As an image forming method capable of forming a high quality image similar to a color photograph, a dye thermal transfer recording method is the subject of attention. Usually in an image forming apparatus utilizing the dye thermal transfer recording method, an endless recording intermediate belt is used, which is a strip-shaped belt with two ends thereof joined. The recording intermediate belt is wrapped around a platen drum so as to travel around a continuous path at a prescribed speed. An outer circumferential surface of the recording intermediate belt has a dye fixing layer transferred and stacked thereon. An image is formed in a prescribed image formation area on the dye fixing layer.

A plurality of image forming sections respectively for forming images of different colors are located around the platen drum. A recording head provided in each image forming section is pressed onto an image forming area of the dye fixing layer, and an image forming operation is performed based on an image signal. Thus, images of different colors are formed on the image forming area of the dye fixing layer. A full-color image is formed on the dye fixing layer by the images of different colors formed by the image forming sections.

The full-color image formed on the dye fixing layer of the recording intermediate belt is transferred onto the recording paper together with the dye fixing layer. The recording paper is drawn from, for example, a roll of a recording paper. The recording paper having the full-color image transferred thereon is cut into a prescribed size by a cutter and discharged to the outside of the apparatus.

In such an image forming apparatus, the recording intermediate belt travels around the path at a prescribed speed due to a high frictional force with an elastic body made of, for example, a rubber layer provided on the outer circumferential surface of the platen drum. The image forming operation is performed by the recording head of each image forming section being pressed onto the recording intermediate belt which is traveling around the path. Thus, an image is formed. Therefore, in the case where while an image is being formed on the recording intermediate belt by the recording head of one of the image forming sections, the recording head of another image forming section is pressed onto the recording intermediate belt or the recording head of another image forming section starts or stops the image forming operation, a load fluctuation or the like can occur to the recording intermediate belt. When the load fluctuation or the like occurs, the image which is being formed by the recording head may have color non-uniformity or the like, which prevents formation of a clear full-color image.

In order to allow the recording intermediate belt to travel around the path at a prescribed speed by the platen drum which is driven to rotate, the recording intermediate belt needs to be wrapped around the platen drum at a high tension. However, when the recording intermediate belt is wrapped around the platen drum at a high tension, the recording intermediate belt is subjected to a large stress. This prevents the recording intermediate belt from being used for a long period of time stably, which necessitates the recording intermediate belt to be frequently replaced.

The recording intermediate belt travels around the path at a prescribed speed by a high frictional force generated by the elastic body made of, for example, rubber, which is provided on the outer circumferential surface of the platen drum. However, depending on the size precision of the recording intermediate belt, the size precision of the parts including the platen drum, assembly precision of the parts, and the like, the recording intermediate belt may travel around the path in a meandering manner. When the recording intermediate belt meanders, the images of different colors which are formed by the respective image forming sections are positionally offset from each other and thus the resultant full-color image may have color non-uniformity or the like.

After the full-color image formed on the recording intermediate belt is transferred onto the recording paper drawn from the roll of recording paper, the recording paper is peeled off from the recording intermediate belt. Then, the recording paper is cut into a prescribed size by a cutter. The recording paper is usually transported to a direction which is different from the transportation direction of the recording intermediate belt. However, in the structure of the apparatus in which the recording paper is peeled off from the recording intermediate belt by transporting the recording paper in a direction which is different from the transportation direction of the recording intermediate belt, the recording paper having the full-color image transferred thereon may not be surely peeled off from the recording intermediate belt.

The recording paper which has been peeled off from the recording intermediate belt is cut by a cutter. When the cutter contacts the recording paper, a load fluctuation or the like occurs to the recording paper and may be conveyed to the recording intermediate belt. In this case also, the image formed on the recording intermediate belt by each image forming section may have color non-uniformity or the like.

The recording intermediate belt which travels around the path by the high frictional force between the recording intermediate belt and the platen drum is worn out and deteriorates over time, and thus is required to be replaced with a new recording intermediate belt.

In this case, the platen drum and each image forming section are supported between a front chassis and a rear chassis. In order to allow a new endless recording intermediate belt to be wrapped around the platen drum in replacement with the old endless recording intermediate belt, it is necessary to separate the chassis which supports one end of the platen drum from the chassis which supports the image forming sections and the like, such that the new endless recording intermediate belt is inserted around one of the chassis.

However, in such a structure in which the chassis which supports the platen drum is separated from the chassis which supports the other chassis, it is not easy to reassemble the two chassis. Therefore, the platen drum may not be positioned with respect to each imaging section with high precision.

A plurality of image forming sections are provided around the platen drum, and an image transfer section for transferring an image formed on the recording intermediate belt onto the recording paper and other elements are provided around the recording intermediate belt. Therefore, the operation of causing the new recording intermediate belt to be wrapped around the platen drum needs to be done in a limited space and thus is difficult.

For solving these inconveniences, the present invention has an objective of providing an image forming apparatus which does not cause color non-uniformity to an image formed on a recording intermediate belt and allows formation of a clear image.

Another objective of the present invention is to provide an image forming apparatus in which the recording intermediate belt is not subjected to a large tension and thus is usable for a long period of time stably.

Still another objective of the present invention is to provide an image forming apparatus which can suppress the recording intermediate belt from meandering and allow the recording intermediate belt to run stably.

Still another objective of the present invention is to provide an image forming apparatus in which a recording paper can be surely peeled off from the recording intermediate belt, the load fluctuation on the recording paper which is caused when cut by a cutter or the like is not conveyed to the recording intermediate belt, and thus color non-uniformity does not occur to an image formed on the recording intermediate belt.

Still another objective of the present invention is to provide an image forming apparatus in which recording intermediate belts can be easily replaced, and the chassis which supports the platen drum can be easily positioned with respect to the other chassis.

The present invention has an objective of providing a recording intermediate belt mounting jig for an image forming apparatus for allowing easy replacement of recording intermediate belts.

DISCLOSURE OF THE INVENTION

An image forming apparatus according to the present invention includes a recording intermediate belt which is made endless so as to travel around a continuous path and has image formation areas and non-image formation areas alternately provided on an outer surface thereof; a plurality of image formation sections located so as to sequentially face the image formation areas on the traveling recording intermediate belt, the plurality of image formation sections each including a recording head for performing an image formation operation based on an image signal while being pressed onto the recording intermediate belt; and an image transfer section for transferring an image formed by each of the image formation sections onto a recording paper. The recording heads of the image formation sections are separated from each other by a distance which is greater than a length of each image formation area on the recording intermediate belt in a traveling direction of the recording intermediate belt.

One of the recording heads of the image forming sections faces a non-image formation area on the recording intermediate belt, all the other recording heads respectively face non-image-formation areas.

Each of the recording heads of the image formation sections is pressed onto the recording intermediate belt and starts an image formation operation in the state of facing the non-image formation area of the recording intermediate belt.

The image transfer section includes a transfer head for transferring an image on the recording intermediate belt onto the recording paper, and the transfer head is separated from the recording head of the image formation section which is closest to the image transfer section by a distance which is greater than a length of each image formation area on the recording intermediate belt in a traveling direction of the recording intermediate belt.

An image forming apparatus according to the present invention includes a recording intermediate belt traveling around a continuous path while being wrapped around a drum driven to rotate and an assisting roller having a smaller diameter than the diameter of the drum; a plurality of image formation sections provided for forming images of different colors in an image formation area on an outer surface of the traveling recording intermediate belt; and an image transfer section for transferring an image formed by each of the image formation sections onto a recording paper. The recording intermediate belt travels around the path at a constant speed and is supplied with a constant torque by the assisting roller.

An image forming apparatus according to the present invention includes a recording intermediate belt traveling around a continuous path while being wrapped around a drum driven to rotate and an assisting roller having a smaller diameter than the diameter of the drum; a plurality of image formation sections provided for forming images of different colors in an image formation area on an outer surface of the traveling recording intermediate belt; an image transfer section for transferring an image formed by each of the image formation sections onto a recording paper; and a roller tilting mechanism for, when the recording intermediate belt is offset with respect to the roller in an axial direction of the roller, moving one end of the roller in such a direction as to compensate for the offset of the recording intermediate belt.

The one end of the roller is movable closer to and farther from the drum for compensating for the offset of the recording intermediate belt.

An image forming apparatus according to the present invention includes a recording intermediate belt traveling around a continuous path while being wrapped around a drum driven to rotate and an assisting roller having a smaller diameter than the diameter of the drum; a plurality of image formation sections provided for forming images of different colors in an image formation area on an outer surface of the traveling recording intermediate belt; an image transfer section for transferring an image formed by each of the image formation sections onto a recording paper; and a peeling roller provided along the roller such that the peeling roller contacts the recording paper having the image transferred thereon by the image transfer section, at a position where the recording paper is peeled off from the recording intermediate belt.

In an image forming apparatus according to the present invention, in which images of different colors are sequentially formed by a plurality of image formation sections in an image formation area on an outer surface of a recording intermediate belt which is made endless and travels around a continuous path while being wrapped around a platen drum, and then the image formed in the image formation area is transferred onto a recording paper by an image transfer section; each of the image formation sections is supported between a rear chassis and a front image formation section chassis; the platen drum is supported by the rear chassis and a front platen drum chassis separately provided from the front image formation section chassis; and the front image formation section chassis and the platen drum chassis are assembled together while positioned with respect to each other by a detachable positioning plate.

The platen drum chassis has an outer circumference which is substantially along a traveling region of the recording intermediate belt.

A belt mounting jig according to the present invention is for use with the above-described image forming apparatus and includes a belt holder which has a cylindrical shape for accommodating the platen drum chassis while engaged with the platen drum chassis, and has an outer circumferential surface substantially along the traveling region of the recording intermediate belt, a portion of the outer circumferential surface having a groove extending in an axial direction of the belt holder; and belt pressing means movable between a holding state of pressing a part of the recording intermediate belt, engaged with the belt holder, on an inner surface of the groove so as to integrate the recording intermediate belt and the belt holder, and a retracted state of being separated from the recording intermediate belt.

BEST MODE FOR CARRYING OUT THE INVENTION

Hereinafter, the present invention will be described by way of illustrative examples with reference to the accompanying drawings.

Figure 1:
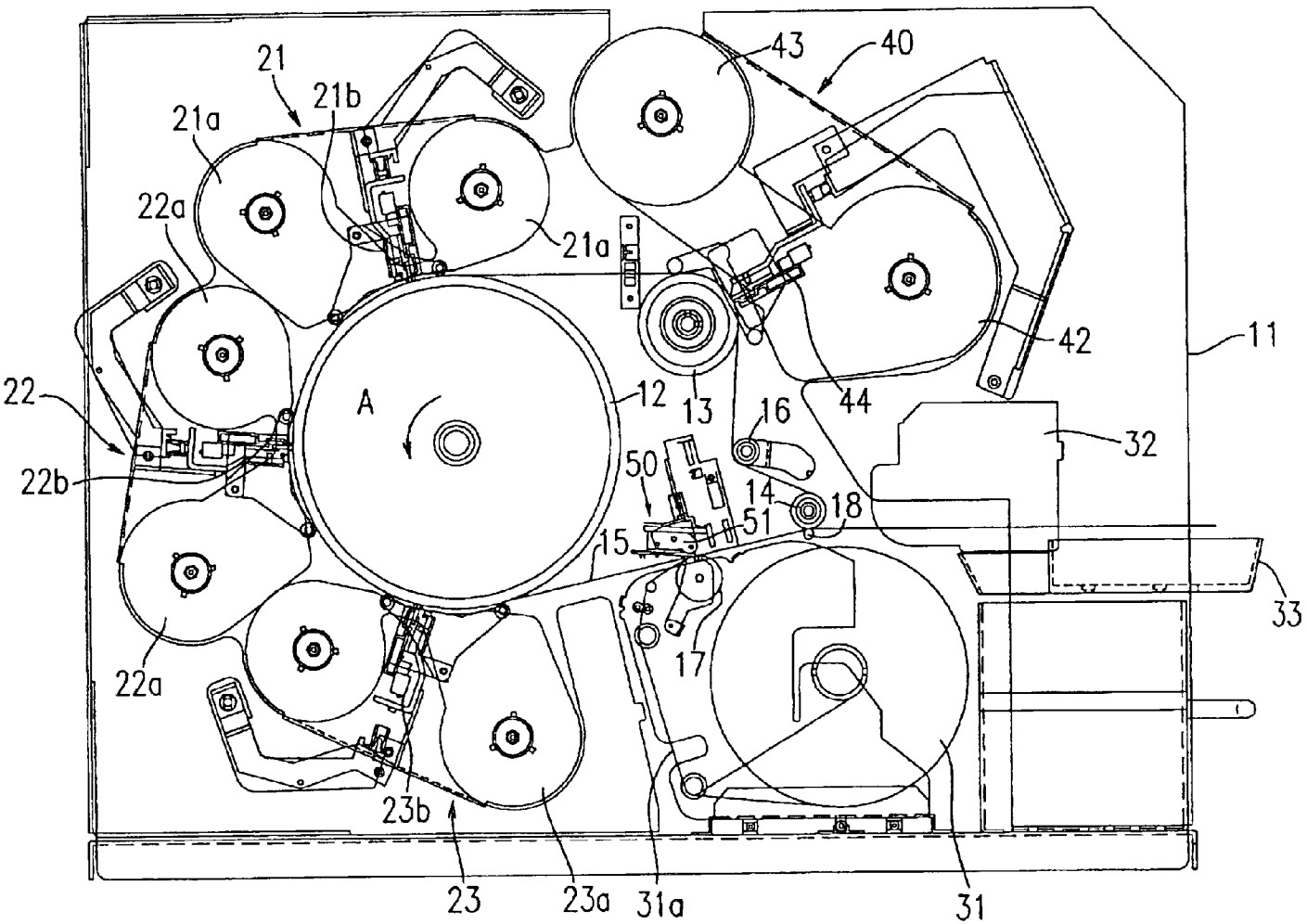
FIG. 1 is a schematic view illustrating a structure of an example of an image forming apparatus according to the present invention.
Figure 3A:
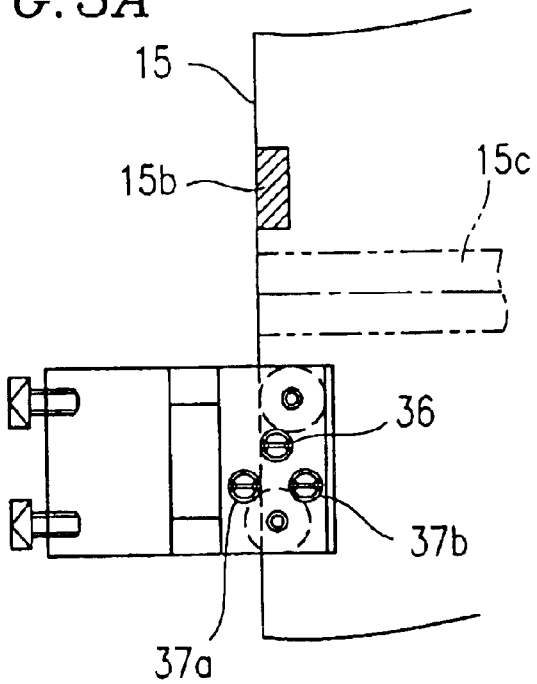
FIG. 3A is a plan view illustrating a schematic structure of a joint sensor and a belt sensor provided in the image forming apparatus.

FIG. 1 is a schematic structural view illustrating an example of an image forming apparatus according to the present invention. In this image forming apparatus, a recording intermediate belt 15 is used, which is endless so as to travel around a continuous path. The recording intermediate belt 15 is formed of a strip-shaped belt body formed of a polyimide film having a thickness of about 25 to about 50 μm, and a functional layer formed of fluorine-based rubber or silicone-based rubber having a thickness of about 5 to about 30 μm. As shown in FIG. 3A, two end surfaces of the belt body are adjoining. A connecting member 15*c* is extended over the adjoining end portions of each end of the belt main body. The connecting member 15*c* connects the ends and makes the belt endless. A joint mark 15*b* is provided on one side of the belt body with an appropriate distance from the joint.

As shown in FIG. 1, a platen drum 12 having a diameter of as large as about 200 mm is provided in substantially a central portion of a rectangular parallelepiped housing 11. A recording intermediate belt 15 is to be wrapped around the platen drum 12. The platen drum 12 is driven to rotate at a prescribed speed in a direction represented with letter A in FIG. 1 by a stepping motor.

The platen drum 12 has a rubber layer as an elastic body on an outer circumferential surface thereof. The rubber layer has a rubber hardness of about 60 to about 70 and acts as a functional layer. The rubber layer provides a high frictional force to the recording intermediate belt 15, so that the recording intermediate belt 15 travels around the path. The recording intermediate belt 15 is allowed to travel around the path accurately at a prescribed speed by the platen drum 12 which is rotated by the stepping motor.

A sub drum 13 having a diameter of about 50 mm is located by the side of the platen drum 12. The recording intermediate belt 15 is to be wrapped around the sub drum 13. An assisting driving roller 14 having a smaller diameter than that of the platen drum 12 is located below the sub drum 13. The recording intermediate belt 15 is wrapped around the platen drum 12, the sub drum 13, and the assisting driving roller 14. A tension roller 16 is pressed onto an outer surface of the recording intermediate belt 15 between the sub drum 13 and the assisting driving roller 14. The tension roller 16 provides the recording intermediate belt 15 with tension. The tension roller 16 is movable to a retracted position where the tension roller 16 is separated from the recording intermediate belt 15.

An assisting driving roller 14 is formed of, for example, a torque limiter. The assisting driving roller 14 is rotated in the same direction as that of the platen drum 12 at a prescribed constant torque, so that the recording intermediate belt 15 travels around the path with a constant torque.

The assisting driving roller 14 has an end which is movable by a roller tilting mechanism described below so as to be closer to or farther from the platen drum 12. Thus, the assisting driving roller 14 is tilted at an appropriate angle with respect to a direction parallel to an axis of the platen drum 12.

A peeling roller 18 having a smaller diameter than that of the assisting driving roller 14 is located below the assisting driving roller 14 there along. The peeling roller 18 is loaded by the assisting driving roller 14 by a spring at a certain pressure. The peeling roller 18 is freely rotatable, so that the recording intermediate belt 15 passes between the assisting driving roller 14 and the peeling roller 18.

A dye fixing layer transfer section 40 is provided so as to face the sub drum 13. The dye fixing layer transfer section 40 transfers a dye fixing layer on a part of the outer surface of the recording intermediate belt 15 facing the sub drum 13.

The dye fixing layer transfer section 40 includes a dye fixing transfer roll 43, which is a rolled dye fixing transfer body. The dye fixing transfer body includes a strip-shaped substrate and a dye fixing layer stacked on the substrate. When the strip-shaped dye fixing transfer body which is drawn from the dye fixing transfer roll 43 faces the recording intermediate belt 15, the dye fixing layer of the dye fixing transfer body is transferred onto the outer surface of the recording intermediate belt 15 by a dye fixing layer transfer head 44. The dye fixing layer is formed of a resin, the dye of which has a high level of fixability. The substrate of the dye fixing transfer body having the dye fixing layer transferred thereon is taken in by take-in sections 21*e*, 22*e* and 23*e*.

A first image formation section 21 is provided above the platen drum 12. The first image formation section 21 forms a yellow image on the dye fixing layer transferred onto the outer surface of the recording intermediate belt 15 by the dye fixing layer transfer section 40. A second image formation section 22 is provided adjacent to and downstream with respect to the first image formation section 21. The term "downstream" is used with respect to the rotation direction of the platen drum 12. The second image formation section 22 forms a magenta image on the dye fixing layer transferred onto the outer surface of the recording intermediate belt 15. A third image formation section 23 is provided adjacent to and downstream with respect to the second image formation section 22. The third image formation section 23 forms a cyan image on the dye fixing layer transferred onto the outer surface of the recording intermediate belt 15.

The first, second and third image formation sections 21, 22 and 23 respectively include dye transfer body cartridges 21*a*, 22*a* and 23*a*. The dye transfer body cartridges 21*a*, 22*a* and 23*a* respectively accommodate rolls of strip-shaped dye transfer bodies having yellow, magenta and cyan dyes. The dye transfer bodies are respectively drawn from feeding sections 21*d*, 22*d* and 23*d*. The dye transfer bodies which are drawn from the feeding sections 21*d*, 22*d* and 23*d* are caused to face the dye fixing layer on the recording intermediate belt 15 and then taken in by a take-in roll 42.

The image formation sections 21, 22 and 23 respectively include recording heads 21*b*, 22*b* and 23*b*. When the dye transfer bodies from the dye transfer body cartridges 21*a*, 22*a* and 23*a* face the dye fixing layer on the recording intermediate belt 15, the recording heads 21*b*, 22*b* and 23*b* performs an image formation operation based on an image signal.

The recording heads 21*b* through 23*b* respectively transfer the yellow, magenta and cyan dyes onto prescribed image formation areas of the dye fixing layer on the outer surface of the recording intermediate belt 15 based on an image signal, so as to form images of the respective colors. The images formed by the yellow, magenta and cyan dyes are sequentially formed on the image formation areas of the recording intermediate belt 15, and as a result, a full-color image is formed on the dye fixing layer in each image formation areas.

Figure 2:
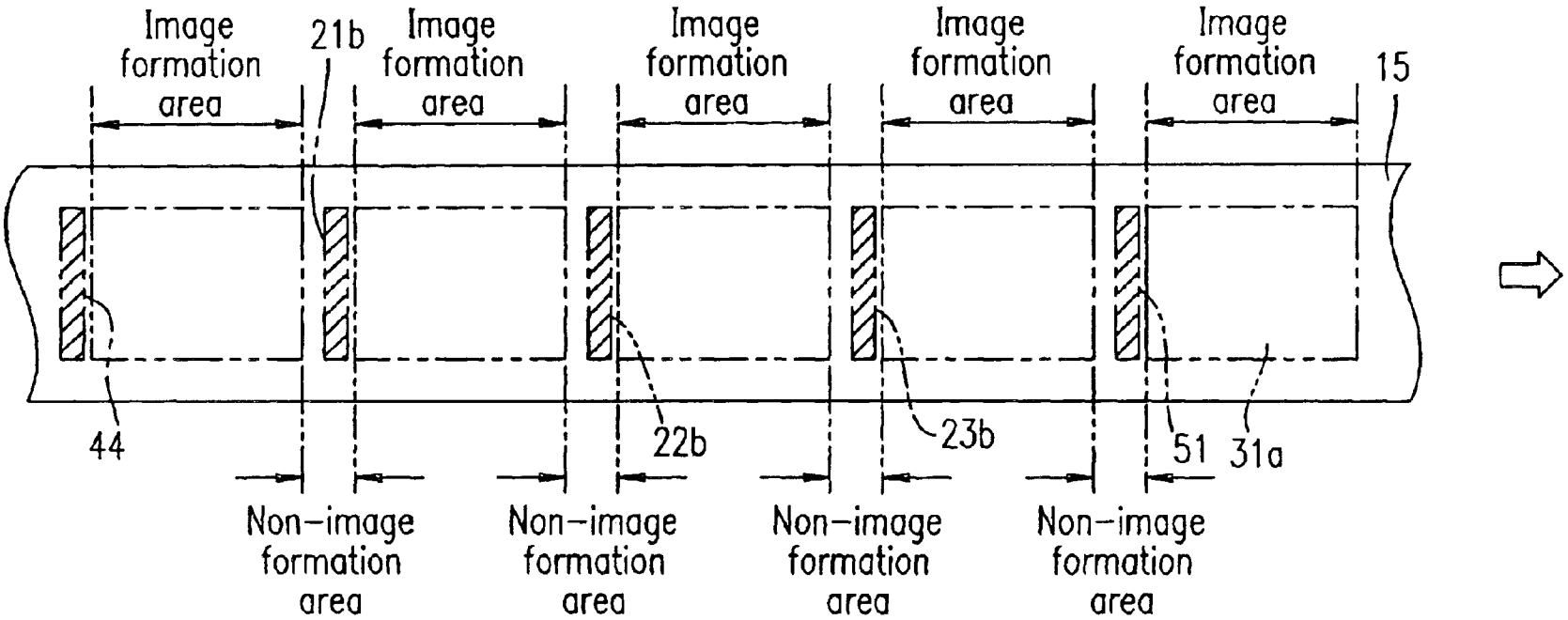
FIG. 2 is a schematic view illustrating the relationship between a recording intermediate belt and a recording head of each image formation section.

As shown in FIG. 2, the outer surface of the recording intermediate belt 15 includes image formation areas and non-image formation areas, where no image is to be formed, alternately.

The dye fixing layer transfer head 44 of the dye fixing layer transfer section 40 and the recording head 21*b* of the first image formation section 21 are provided at a distance which is slightly longer than the length of the image formation area in the traveling direction of the recording intermediate belt 15. The length of the image formation area is equal to a prescribed image size. In the case where, for example, the image size is A6, the dye fixing layer transfer head 44 and the recording head 21*b* of the first image formation section 21 are separated from each other by 110 mm which is longer than the image formation area of an A6 sheet.

The recording head 21*b* of the first image formation section 21 and the recording head 22*b* of the second image formation section 22 are also provided at a distance which is slightly longer than the length of the image formation area in the traveling direction of the recording intermediate belt 15. The recording head 22*b* of the second image formation section 22 and the recording head 23*b* of the third image formation section 23 are also provided at a distance which is slightly longer than the length of the image formation area in the traveling direction of the recording intermediate belt 15.

Accordingly, when the recording head 23*b* of the third image formation section 23 faces a non-image formation area, the recording head 22*b* of the second image formation section 22 faces the next non-image formation area which is located away from the first non-image formation area with an image formation area interposed therebetween. The recording head 21*b* of the first image formation section 21 also faces the next non-image formation area which is located away from the second non-image formation area with an image formation area interposed therebetween. The dye fixing layer transfer head 44 of the dye fixing layer transfer section 40 also faces the next non-image formation area which is located away from the third non-image formation area with an image formation area interposed therebetween.

A recording paper roll 31 is detachably provided below the assisting driving roller 14. The recording paper roll 31 is a roll of a recording paper 31*a*, which is a plain paper. The recording paper 31*a* is drawn from below the recording paper roll 31 toward the platen drum 12, placed on the outer surface of the recording intermediate belt 15, and pressure-contacted on the outer surface of the recording intermediate belt 15 by a transfer roller 17 provided between the platen drum 12 and the assisting driving roller 14.

An image transfer section 50 is provided within the traveling region of the recording intermediate belt 15, facing the transfer roller 17. The image transfer section 50 includes a transfer head 51 for transferring the full-color image formed on the dye fixing layer in the image formation area on the recording intermediate belt 15 on the recording paper 31*a*, which is pressure-contacted on the recording intermediate belt 15. The full-color image is transferred together with the dye fixing layer. The transfer head 51 is allowed to be in contact with, or separated from, the recording intermediate belt 15. While the transfer head 51 is in contact with the recording intermediate belt 15, the full-color image formed on the recording intermediate belt 15 is transferred onto the recording paper 31*a* together with the dye fixing layer.

The transfer head 51 is provided away from the recording head 23*b* of the third image formation section 23 at a distance slightly longer than the image formation area on the recording intermediate belt 15 in the traveling direction of the recording intermediate belt 15. Accordingly, when the transfer head 51 faces a non-image formation area, the recording head 23*b* of the third image formation section 23 faces the next non-image formation area which is located away from the above-mentioned non-image formation area with an image formation area interposed therebetween. The recording heads 22*b* and 21*b* of the second and first image formation sections 22 and 21 also face the subsequent non-image formation areas which are sequentially located an image formation area away. The dye fixing layer transfer head 44 of the dye fixing layer transfer section 40 also faces the next non-image formation area similarly located an image formation area away.

The recording intermediate belt 15 and the recording paper 31*a* pass between the assisting driving roller 14 and the peeling roller 18. After passing between the assisting driving roller 14 and the peeling roller 18, the recording intermediate belt 15 is transported upward along the assisting driving roller 14. In contrast, the recording paper 31*a* having a full-color image transferred thereon is transported substantially straight and thus is peeled off from the recording intermediate belt 15.

A cutter 32 for cutting the recording paper 31*a* which is being transported is provided downstream with respect to the assisting driving roller 14 in the transporting direction of the recording paper 31*a*. The cutter 32 is located above the transportation region of the recording paper 31*a*. The recording paper 31*a*, which has a full-color image transferred thereon and is transported substantially straight, passes below the cutter 32. When the area of the recording paper 31*a* on which the full-color image is formed is outside the housing 11, the cutter 32 is driven to cut the recording paper 31*a*. The cut-out portion of the recording paper 31*a* is accommodated in a discharge tray 33 provided outside the housing 11.

Figure 3B:
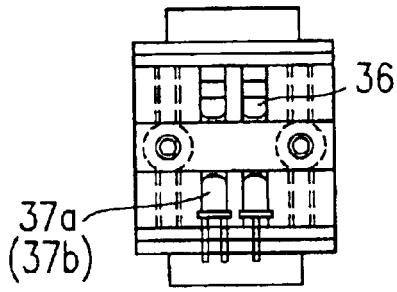
FIG. 3B is a side view thereof.
Figure 3C:
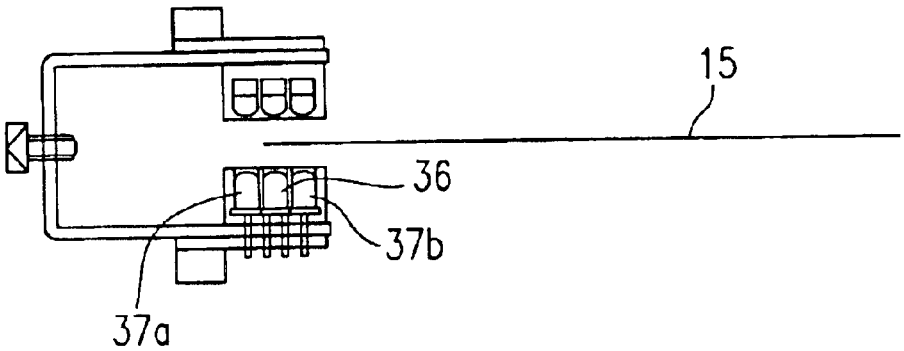
FIG. 3C is a front view thereof.

A joint sensor 36 is provided between the sub drum 13 and the platen drum 12. The joint sensor 36 detects the joint mark 15*b* made on one side of the recording intermediate belt 15. FIG. 3A is a plan view of the joint sensor 36 and the vicinity thereof, FIG. 3B is a side view thereof, and FIG. 3C is a front view thereof.

A first belt sensor 37*a* and a second belt sensor 37*b* are provided integrally with the joint sensor 36 in the vicinity of the joint sensor 36. The first belt sensor 37*a* and the second belt sensor 37*b* detect any offset of the joint mark 15*b* in a width direction of the recording intermediate belt 15. The joint sensor 36, and the first and second belt sensors 37*a* and 37*b* are formed of, for example, a transmission-type photosensor.

The first belt sensor 37*a* and the second belt sensor 37*b* are located at a prescribed distance therebetween in the width direction of the recording intermediate belt 15. The first belt sensor 37*a* and the second belt sensor 37*b* are activated when the joint sensor 36 detects the joint mark 15*b*. The first belt sensor 37*a* and the second belt sensor 37*b* are turned on when detecting the joint mark 15*b*.

While the joint mark 15*b* of the recording intermediate belt 15 is located between the belt sensors 37*a* and 37*b*, the belt sensors 37*a* and 37*b* are both off. When the recording intermediate belt 15 meanders toward the first belt sensor 37*a* in the width direction of the recording intermediate belt 15 by a prescribed distance, the first belt sensor 37*a* detects the joint mark 15*b* and thus is turned on. When the recording intermediate belt 15 is offset in the opposite direction by a prescribed distance, the second belt sensor 37*b* detects the joint mark 15*b* and thus is turned on.

Figure 4A:
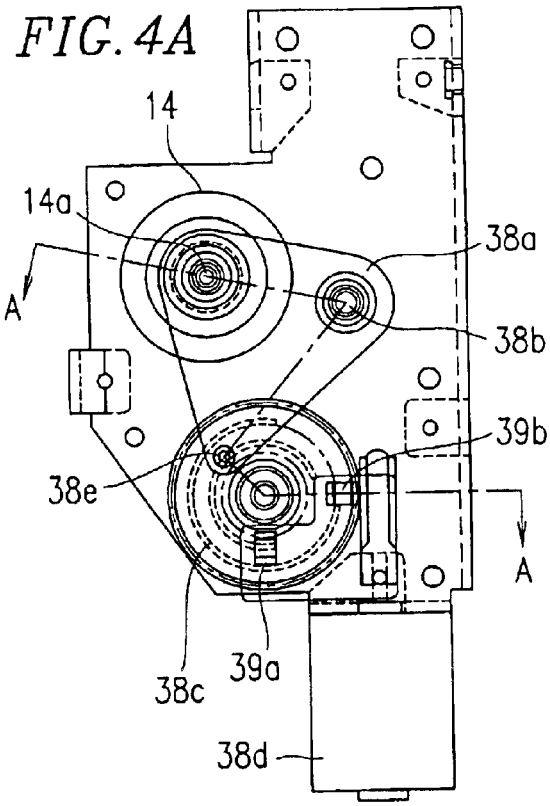
FIG. 4A is a side view illustrating a roller tilting mechanism for tilting an assisting driving roller provided in the image forming apparatus.
Figure 4B:
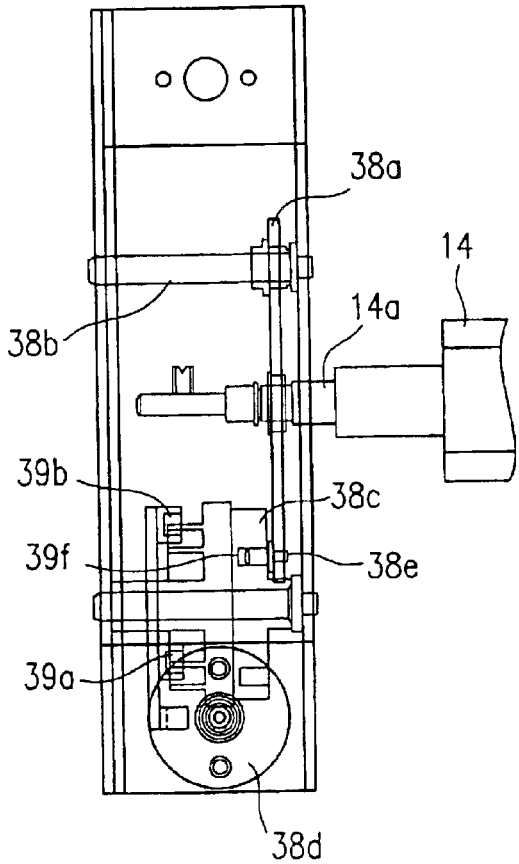
FIG. 4B is a cross-sectional view along line A—A of FIG. 4A.

FIGS. 4A and 4B show a roller tilting mechanism. The roller tilting mechanism moves one end of the assisting driving roller 14, located below the sub drum 13, closer to or farther from the platen drum 12, such that the assisting driving roller 14 is tilted with respect to a direction parallel to the axis of the platen drum 12. FIG. 4A is a side view of the roller tilting mechanism, and FIG. 4B is a cross-sectional view thereof along line A—A of FIG. 4A.

The assisting driving roller 14 includes a roller shaft 14*a*. An end of the roller shaft 14*a* is connected to a cam follower plate 38*a*. The cam follower plate 38*a* is formed of a flat triangular plate. The one end of the roller shaft 14*a* is pivotably supported in the vicinity of one of the corners of the cam follower plate 38*a*. An area of the cam follower plate 38*a* which is in the vicinity of another corner thereof is pivotably supported to the housing 11 by a support pin 38*b*. By the cam follower plate 38*a* pivoting in one direction about the support pin 38*b*, the one end of the assisting driving roller 14 moves closer to the platen drum 12. When the cam follower plate 38*a* pivots in the opposite direction, the one end of the assisting driving roller 14 moves farther from the platen drum 12.

An area of the cam follower plate 38*a* which is in the vicinity of the remaining corner thereof has a cam follower 38*e* formed of a pin. The cam follower 38*e* is slidably engaged with a cam groove 38*f* (See FIG. 4B) provided in a disc-shaped driving cam 38*c*.

The driving cam 38*c* is rotated forward or backward by a motor 38*d*. The forward and backward rotation of the driving cam 38*c* moves the cam follower 38*e* in the rotation directions of the driving cam 38*c*. Thus, the cam follower plate 38*a* is pivoted in two directions about the support pin 38*b*. The motor 38*d* is driven forward or backward based on the detection result of the first and second belt sensors 37*a* and 37*b*.

A first motor stop sensor 39*a* and a second motor stop sensor 39*b* are provided in the vicinity of the driving cam 38*c*. The first motor stop sensor 39*a* and the second motor stop sensor 39*b* respectively detect a forward rotation of the driving cam 38*c* and a backward rotation of the driving cam 38*c* at a prescribed angle by the rotation of the motor 38*d*. Thus, the first motor stop sensor 39*a* and the second motor stop sensor 39*b* respectively stop the forward rotation and the backward rotation of the motor 38*d*. The first and second motor stop sensors 39*a* and 39*b* are located in a pivoting region of, and around, the disc-shaped driving cam 38*c*, and are distanced from each other by ¼ of the outer circumference of the driving cam 38*c*. When the driving cam 38*c* is pivoted over ¾ of the outer circumference thereof in one direction by the forward rotation of the motor 38*d*, the first motor stop sensor 39*a* is turned on and thus stops the forward rotation of the motor 38*d*. When the driving cam 38*c* is pivoted over ¾ of the outer circumference thereof in the opposite direction by the backward rotation of the motor 38*d*, the second motor stop sensor 39*b* is turned on and thus stops the backward rotation of the motor 38*d*.

In an image forming apparatus having the above-described structure, a prescribed number of full-color images can be formed continuously. In this case, dye fixing layers are continuously transferred onto the outer surface of the recording intermediate belt 15 which travels around the path by the platen drum 12 and the assisting driving roller 14. The transference is performed by the dye fixing layer transfer head 44 of the dye fixing layer transfer section 40. A first image formation area on the dye fixing layer transferred onto the recording intermediate belt 15 is transported to the first image formation section 21 by the movement of the recording intermediate belt 15.

The position of the first image formation area transferred onto the recording intermediate belt 15 is detected based on the rotation of the stepping motor for driving the platen drum 12 to rotate. When a non-image formation area immediately preceding the first image formation area faces the recording head 21*b* of the first image formation section 21, the recording head 21*b* is pressed onto the non-image formation area. The recording head 21*b* starts the image formation operation in synchronization with the movement of the recording intermediate belt 15.

In this case, the dye fixing layer transfer head 44 of the dye fixing layer transfer section 40 is in contact with a non-image formation area immediately subsequent to the first image formation area of the recording intermediate belt 15. Accordingly, even though the load fluctuation caused when the recording head 21*b* of the first image formation section 21 contacts the recording intermediate belt 15 has adverse influence on the transfer of the dye fixing layer by the dye fixing layer transfer head 44, no specific problem occurs since no image is to be formed on the relevant portion of the dye fixing layer.

The recording head 21*b* of the first image formation section 21, which starts to perform the image formation operation while facing the non-image formation area, forms a yellow image on the dye fixing layer in the first image formation area based on a prescribed image signal as the recording intermediate belt 15 travels. When the yellow image is formed on the first image formation area, the recording head 21*b* of the first image formation section 21 is pressed onto the non-image formation area immediately subsequent to the first image formation area of the recording intermediate belt 15. Then, the image formation operation of the recording head 21*b* is stopped.

At this point, a non-image formation area immediately preceding the first image formation area in which the yellow image has been formed by the recording head 21*b* faces the recording head 22*b* of the second image formation section 22. The recording head 22*b* of the second image formation section 22 is pressed onto the non-image formation area, and an image formation operation is started in synchronization with the movement of the recording intermediate belt 15.

In this case, the recording head 21*b* of the first image formation section 21 is pressed onto the non-image formation area immediately subsequent to the first image formation area in which the yellow image has been formed. Substantially simultaneously with the start of the image formation operation of the recording head 22*b* of the second image formation section 22, the recording head 21*b* starts an image formation operation. Accordingly, the image formation operation by the recording head 21*b* of the first image formation section 21 is not adversely influenced by the recording head 22*b* of the second image formation section 22 being pressed onto the recording intermediate belt 15 or by the recording head 22*b* starting the image formation operation. The image formation operation by the recording head 22*b* of the second image formation section 22 is not adversely influenced by the recording head 21*b* of the first image formation section 21 starting the image formation operation.

The dye fixing layer transfer head 44 of the dye fixing layer transfer section 40 is also pressed onto a non-image formation area immediately subsequent to a second image formation area of the recording intermediate belt 15. Therefore, even though the transfer of the dye fixing layer by the dye fixing layer transfer head 44 is adversely influenced by the recording head 22*b* of the second image formation section 22 being pressed onto the recording intermediate belt 15 and by the recording heads 22*b* and 21*b* starting the respective image formation operations, no specific problem occurs since no image is to be formed on the relevant portion of the dye fixing layer.

The recording head 22*b* of the second image formation section 22, which starts to perform the image formation operation while facing the non-image formation area, forms a magenta image on the dye fixing layer in the first image formation area based on a prescribed image signal as the recording intermediate belt 15 travels. The recording head 21*b* of the first image formation section 21, which starts to perform the image formation operation while facing the non-image formation area, also forms a yellow image on the dye fixing layer in the second image formation area based on a prescribed image signal as the recording intermediate belt 15 travels. Then, by the movement of the recording intermediate belt 15, the recording head 22*b* of the second image formation section 22 and the recording head 21*b* of the first image formation section 21 are pressed onto non-image formation are as immediately subsequent to the first image formation area and the second image formation area of the recording intermediate belt 15. Thus, the image formation operations of the recording heads 22*b* and 21*b* are stopped.

At this point, the non-image formation area immediately preceding the first image formation area in which the yellow and the magenta images have been formed faces the recording head 23*b* of the third image formation section 23. The recording head 23*b* of the third image formation section 23 is pressed onto the non-image formation area, and an image formation operation is started in synchronization with the transportation of the recording intermediate belt 15.

In this case also, the recording head 22*b* of the second image formation section 22 and the recording head 21*b* of the first image formation section 21 are pressed onto the non-image formation areas immediately subsequent to the first image formation area and the second image formation area. Substantially simultaneously with the start of the image formation operation of the recording head 23*b* of the third image formation section 23, the recording heads 21*b* and 22*b* start respective image formation operations. Accordingly, the image formation operations by the recording head 22*b* of the second image formation section 22 and the recording head 21*b* of the first image formation section 21 are not adversely influenced by the recording head 23*b* of the third image formation section 23 being pressed onto the recording intermediate belt 15 or by the recording head 23*b* starting the image formation operation. The image formation operation by the recording head 23*b* of the third image formation section 23 is not adversely influenced by the recording head 22*b* of the second image formation section 22 and the recording head 21*b* of the first image formation section 21 starting the image formation operations.

Even if the transfer of the dye fixing layer by the dye fixing layer transfer head 44 of the dye fixing layer transfer section 40 is adversely influenced, no specific problem occurs since no image is to be formed on the relevant portion of the dye fixing layer.

The recording head 23*b* of the third image formation section 23, which starts to perform the image formation operation while facing the non-image formation area, forms a cyan image on the dye fixing layer in the first image formation area based on a prescribed image signal as the recording intermediate belt 15 travels. The recording head 22*b* of the second image formation section 22 and the recording head 21*b* of the first image formation section 21, which start to perform the image formation operations while facing the non-image formation areas, also form a magenta image and a yellow image on the dye fixing layer in the second image formation area and a third image formation area based on a prescribed image signal as the recording intermediate belt 15 travels.

Then, by the movement of the recording intermediate belt 15, the recording head 23*b* of the third image formation section 23 is pressed onto the non-image formation area immediately subsequent to the first image formation area of the recording intermediate belt 15. The recording head 22*b* of the second image formation section 22 and the recording head 21*b* of the first image formation section 21 are respectively pressed onto the non-image formation areas immediately subsequent to the second image formation area and the third image formation area of the recording intermediate belt 15. Then, the image formation operations of the recording heads 23*b*, 22*b* and 21*b* are stopped.

In this manner, a full-color image is formed on the first image formation area, a yellow and magenta image is formed on the second image formation area, and a cyan image is formed on the third image formation area.

After this, the image formation operations recording heads 21*b* through 23*b* are started and stopped in a similar manner in non-image formation areas. Thus, images are formed in the image formation areas by the recording heads 21*b* through 23*b* as the recording intermediate belt 15 travels. As a result, full-color images are continuously formed in the image formation areas of the recording intermediate belt 15.

When the transfer of the dye fixing layer of a length corresponding to the prescribed number of image formation areas is finished, the dye fixing layer transfer head 44 of the dye fixing layer transfer section 40, which has been in contact with the non-image formation area of the recording intermediate belt 15, is separated therefrom. In this case, the recording heads 21*b* through 23*b* of the image formation sections 21 through 23 are pressed onto the non-image formation areas of the recording intermediate belt 15. Therefore, even though a load fluctuation or the like is caused to the recording intermediate belt 15 when the dye fixing layer transfer head 44 is separated from the recording intermediate belt 15, the image formation operations by the image formation sections 21 through 23 are not adversely influenced.

The recording heads 21*b* through 23*b* of the image formation sections 21 through 23 are pressed onto the non-image formation areas after the dye fixing layer of the recording intermediate belt 15 passes. Thereafter, the recording heads 21*b* through 23*b* finish the image formation operations and are sequentially separated from the recording intermediate belt 15. When one of the recording heads 21*b* through 23*b* of the image formation sections 21 through 23 is separated from the recording intermediate belt 15, the other recording heads are pressed onto the non-image formation areas or have already been separated from the recording intermediate belt 15. Therefore, even though a load fluctuation or the like is caused to the recording intermediate belt 15 when each of the recording heads 21*b* through 23*b* is separated from the recording intermediate belt 15, the image formation operations or the like performed by the other recording heads are not adversely influenced.

In the case where a full-color image is formed in only one image formation area, instead of forming full-color images sequentially in the image formation areas of the recording intermediate belt 15, the dye fixing layer which is to be transferred onto the recording intermediate belt 15 which is traveling around the path by the dye fixing layer transfer head 44 of the dye fixing layer transfer section 40 is cut into a prescribed size corresponding to one image formation area based on an image signal. The recording heads 21*b* through 23*b* of the first through third image formation sections 21 through 23 form images of a prescribed color on the dye fixing layer.

In this case, the recording heads 21*b* through 23*b* of the image formation sections 21 through 23 are pressed onto non-image formation areas of the recording intermediate belt 15 on which no dye fixing layer has been transferred, and thus start respective image formation operations. After the image formation area passes and the recording heads 21*b* through 23*b* are pressed onto the non-image formation areas, the recording heads 21*b* through 23*b* stop the respective image formation operations and are separated from the recording intermediate belt 15. Therefore, even though a load fluctuation or the like is caused to the recording intermediate belt 15 by one of the recording heads 21*b* through 23*b*, the image formation operations by the other recording heads are not adversely influenced.

When full-color images are formed on the image formation areas of the dye fixing layer, the image formation areas are sequentially transported to the image transfer section 50 by the travel of the recording intermediate belt 15. By the transfer head 51 of the image transfer section 50 being pressure-contacted on the recording intermediate belt 15, the dye fixing layer having the full-color images formed thereon are transferred onto the recording paper 31*a*, which is transported integrally with the recording intermediate belt 15.

In this case also, the transfer head 51 is pressed onto a non-image formation area of the recording intermediate belt 15 on which no fixing layer has been transferred. When an image formation area passes, the image formed in the image formation area is transferred onto the recording paper 31*a*. Accordingly, even though a load fluctuation occurs to the recording intermediate belt 15 when the transfer head 51 is pressed onto the recording intermediate belt 15, the image formation operations of the recording heads 21*b* through 23*b* of the image formation sections 21 through 23 are not adversely influenced.

The recording paper 31*a* having the full-color images transferred thereon is transported and passes between the assisting driving roller 14 and the peeling roller 18, integrally with the recording intermediate belt 15. Then, the recording intermediate belt 15 is transported upward, while the recording paper 31*a* is transported substantially straight. Thus, the recording paper 31*a* is peeled off from the recording intermediate belt 15. At this point, the peeling roller 18 is pressure-contacted on the assisting driving roller 14 with the recording paper 31*a* interposed therebetween, substantially along the entire axial length of the peeling roller 18. Thus, the recording paper 31*a* is pressure-contacted on the assisting driving roller 14 by the peeling roller 18 in the width direction. As a result, the position at which the recording paper 31*a* having the full-color images transferred thereon is peeled off from the recording intermediate belt 15 is made clear, and thus the recording paper 31*a* is peeled off from the recording intermediate belt 15 without fail. In this way, the level of performance of peeling off the recording paper 31*a* from the recording intermediate belt 15 is improved.

The recording paper 31*a*, which has been peeled off from the recording intermediate belt 15, is transported substantially straight and passes below the cutter 32. Then, the recording paper 31*a* is positioned above the discharge tray 33 provided outside the housing 11. When the recording paper 31*a* is outside the housing 11 by the length corresponding to the image formation area, the cutter 32 is driven to cut the recording paper 31*a*. The cut-off portion of the recording paper 31*a* is accommodated in the discharge tray 33 located below.

When the recording paper 31*a* is cut into a prescribed length by driving the cutter 32, a load fluctuation occurs to the recording paper 31*a* by the contact of the cutter 32 on the recording paper 31*a*. However, the load fluctuation or the like applied on the recording paper 31*a* is prevented from being conveyed to the recording intermediate belt 15 by the peeling roller 18 since the peeling roller 18 is pressure-contacted on the recording paper 31*a* facing the assisting driving roller 14.

As a result, the load fluctuation or the like by the cutter 32 does not occur to the recording intermediate belt 15 while the images are being formed by the recording heads 21*b* through 23*b* in the image formation sections 21 through 23. Therefore, the images formed by the image formation sections 21 through 23 do not have color non-uniformity or the like.

During the image formation operations, the recording intermediate belt 15 may undesirably meander depending on the size precision of the recording intermediate belt 15, the size precision of the platen drum 12, the sub drum 13, and the assisting driving roller 14, the assembly precision thereof and the like. When the recording intermediate belt 15 meanders, the recording intermediate belt 15 is offset in the axial direction of the assisting driving roller 14 (i.e., the width direction of the recording intermediate belt 15).

When the recording intermediate belt 15 further meanders, the recording intermediate belt 15 is significantly offset with respect to the recording heads 21*b* through 23*b* of the image formation sections 21 through 23, which prevents accurate image formation on the recording intermediate belt 15. According to the present invention, the roller tilting mechanism suppresses the meandering of the recording intermediate belt 15.

Figure 5A:
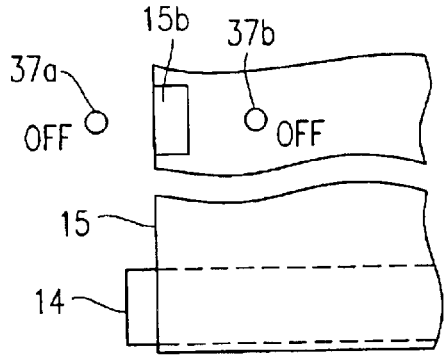
FIGS. 5A through 5D are each a schematic view illustrating the relationship between the assisting driving roller and the recording intermediate belt.

The roller tilting mechanism operates as follows. When the joint sensor 36 detects the joint mark 15*b* of the recording intermediate belt 15, the first and second belt sensors 37*a* and 37*b* located in the vicinity of the joint sensor 36 start detection operations. For example, when, as shown in FIG. 5A, the joint mark 15*b* is offset toward the first belt sensor 37*a* by a prescribed distance and the first belt sensor 37*a* detects the joint mark 15*b* and is turned on, the motor 38*d* provided in the roller tilting mechanism is driven to rotate forward, and the driving cam 38*c* is pivoted in a prescribed direction. Thus, the cam follower plate 38*a* is pivoted about the support pin 38*b*.

Figure 5B:
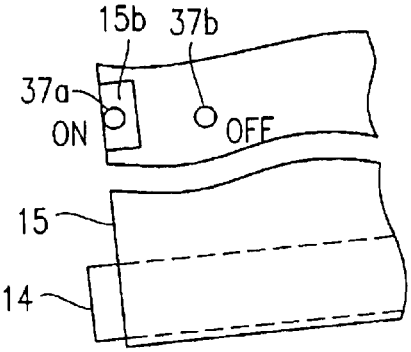

Then, when the first motor stop sensor 39*a* detects that the cam follower plate 38*a* has pivoted by ¾ of the circumference thereof, the forward rotation of the motor 38*d* is stopped. Thus, as shown in FIG. 5B, the end of the roller shaft 14*a* of the assisting driving roller 14 supported by the cam follower plate 38*a* is moved farther from the platen drum 12, and the assisting driving roller 14 is tilted with respect to the direction parallel to the axis of the platen drum 12.

Figure 5C:
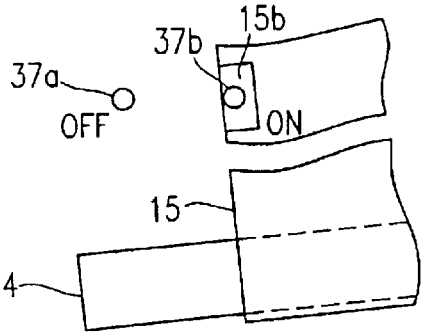

When the recording intermediate belt 15 travels in this state, the recording intermediate belt 15 wrapped around the assisting driving roller 14 gradually slides toward the second belt sensor 37*b* from the first belt sensor 37*a*. When the recording intermediate belt 15 slides over a prescribed distance and the second belt sensor 37*b* detects the joint mark 15*b* and is turned on during the detection operation as shown in FIG. 5C, the motor 38*d* included in the roller tilting mechanism is driven to rotate backward, and the driving cam 38*c* is pivoted in a prescribed direction. Thus, the cam follower plate 38*a* is pivoted about the support pin 38*b*. Then, when the second motor stop sensor 39*b* detects that the cam follower plate 38*a* has pivoted by ¾ of the circumference thereof, the backward rotation of the motor 38*d* is stopped.

Figure 5D:
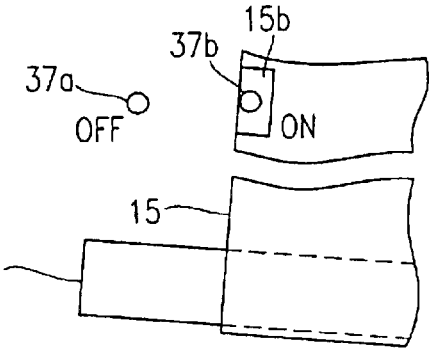

Thus, as shown in FIG. 5D, the end of the roller shaft 14*a* of the assisting driving roller 14 supported by the cam follower plate 38*a* is moved closer to the platen drum 12, and the assisting driving roller 14 is tilted in the opposite direction.

When the recording intermediate belt 15 travels around the path in this state, the recording intermediate belt 15 wrapped around the assisting driving roller 14 gradually slides toward the first belt sensor 37*a* from the second belt sensor 37*b* as traveling. When the recording intermediate belt 15 slides over a prescribed distance, the first belt sensor 37*a* detects the joint mark 15*b* and is turned on as shown in FIG. 5A.

After this, the same operation is repeated, so that the recording intermediate belt 15 is controlled to be between the first belt sensor 37*a* and the second belt sensor 37*b*, which prevents the recording intermediate belt 15 from being drastically meandering. As a result, the recording intermediate belt 15 is prevented from being drastically offset with respect to the recording heads 21*b* through 23*b*, allowing images to be appropriately formed by the recording heads 21*b* through 23*b*.

The recording intermediate belt 15 having the fixing layer on which images are to be formed is driven to travel at a certain speed by the platen drum 12, which is driven to rotate. The recording intermediate belt 15 is also supplied with a certain torque by the assisting driving roller 14. Accordingly, the recording intermediate belt 15 moves between the platen drum 12 and the assisting driving roller 14 with a constant torque, and the tension of the recording intermediate belt 15 is not decreased. As appreciated, the tension of recording intermediate belt 15, which is driven to travel by the rotation of the platen drum 12, does not decrease downstream with respect to the platen drum 12 in the traveling direction of the recording intermediate belt 15. This suppresses the initial tension of the recording intermediate belt 15. This allows the running load of the recording intermediate belt 15 to be alleviated, and so allows the life of the recording intermediate belt 15 to be extended.

The recording intermediate belt 15, which is wrapped around the platen drum 12, the sub drum 13, and the assisting driving roller 14, travels around the path by the high frictional force between the recording intermediate belt 15 and the outer circumferential surface of the platen drum 12, and thus deteriorates over time. When deteriorated, the recording intermediate belt 15 is replaced with a new recording intermediate belt.

Figure 6:
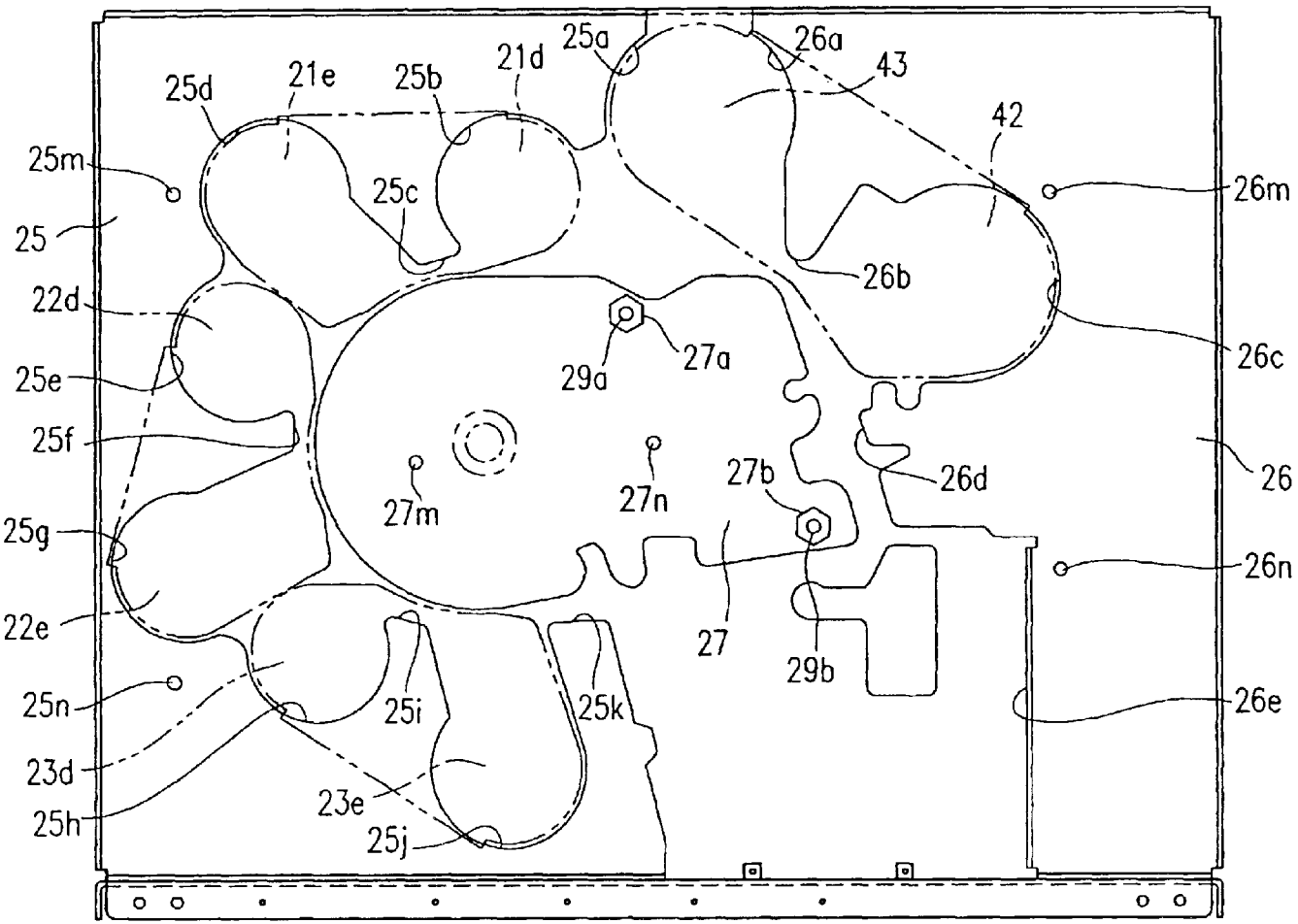
FIG. 6 is a schematic structural view of a chassis provided on the side of the image forming apparatus.

FIG. 6 is a schematic structural view of chassis provided in a front part of the image forming apparatus. An image formation section chassis 25 is provided on one side portion of the housing 11 when seen from the front thereof. The image formation section chassis 25 integrally supports the recording heads 21*b* through 23*b* of the first through third image formation sections 21 through 23. A dye fixing layer transfer section chassis 26 is provided on the other side portion of the housing 11 for supporting the dye fixing layer transfer head 44 of the dye fixing layer transfer section 40.

The image formation section chassis 25 covers a side portion accommodating the image formation sections 21 through 23 provided along the traveling region of the recording intermediate belt 15 in the front part of the image forming apparatus. The dye fixing layer transfer section chassis 26 covers a side portion accommodating the dye fixing layer transfer section 40 provided along the traveling region of the recording intermediate belt 15 in the front part of the image forming apparatus. In a central region between the image formation section chassis 25 and the dye fixing layer transfer section chassis 26, a space surrounding the traveling region of the recording intermediate belt 15 wrapped around the sub drum 13 and the assisting driving roller 14 is formed. Between a bottom portion of the image formation section chassis 25 and a bottom portion of the dye fixing layer transfer section chassis 26, a space for accommodating the recording paper roll 31 is formed.

A top portion of the image formation section chassis 25 which is in the vicinity of a top portion of the dye fixing layer transfer section chassis 26 has a first edge 25*a* which is recessed in an arc. The top portion of the dye fixing layer transfer section chassis 26 in the vicinity of the first edge 25*a* also has a first edge 26*a* which is recessed in an arc. The dye fixing transfer roll 43 of the dye fixing layer transfer section 40 is accommodated between the first edge 25*a* of the top portion of the image formation section chassis 25 and the first edge 26*a* of the top portion of the dye fixing layer transfer section chassis 26.

The top portion of the image formation section chassis 25 has a second edge 25*b* recessed substantially in a semi-circle in continuation from the first edge 25*a*. The substantially semi-circular portion defined by the second edge 25*b* accommodates the feeding section 21*d* for feeding the dye transfer body from the dye transfer body cartridge 21*a* in the first image formation section 21. The image formation section chassis 25 has a third edge 25*c* forming a projecting portion projecting obliquely downward in continuation from the first edge 25*a*. The projection portion defined by the third edge 25*c* supports the recording head 21*b* of the first image formation section 21 (see FIG. 1).

The image formation section chassis 25 has a fourth edge 25*d* recessed substantially in a semi-circle in continuation from the third edge 25*c*. The substantially semi-circular portion defined by the fourth edge 25*d* accommodates the take-in section 21*e* of the dye transfer body cartridge 21*a* in the first image formation section 21. The image formation section chassis 25 has a fifth edge 25*e* recessed substantially in a semi-circle in continuation from the fourth edge 25*d*. The substantially semi-circular portion defined by the fifth edge 25*e* accommodates the feeding section 22*d* for feeding the dye transfer body from the dye transfer body cartridge 22*a* in the second image formation section 22.

The image formation section chassis 25 has a sixth edge 25*f* forming a projecting portion projecting almost horizontally toward the inside of the image forming apparatus in continuation from the fifth edge 25*e*. The projection portion defined by the third edge 25*f* supports the recording head 22*b* of the second image formation section 22 (see FIG. 1).

The image formation section chassis 25 has a seventh edge 25*g* recessed substantially in a semi-circle in continuation from the sixth edge 25*f*. The substantially semi-circular portion defined by the seventh edge 25*g* accommodates the take-in section 22*e* of the dye transfer body cartridge 22*a* in the second image formation section 22. The image formation section chassis 25 has an eighth edge 25*h* recessed substantially in a semi-circle in continuation from the seventh edge 25*g*. The substantially semi-circular portion defined by the eighth edge 25*h* accommodates the feeding section 23*d* for feeding the dye transfer body from the dye transfer body cartridge 23*a* in the third image formation section 23.

The image formation section chassis 25 has a ninth edge 25*i* forming a projecting portion projecting upward in continuation from the eighth edge 25*h*. The projection portion defined by the ninth edge 25*i* supports the recording head 23*b* of the third image formation section 23 (see FIG. 1). The image formation section chassis 25 has a tenth edge 25*j* recessed substantially in a semi-circle in continuation from the ninth edge 25*i*. The substantially semi-circular portion defined by the tenth edge 25*i* accommodates the take-in section 23*e* of the dye transfer body cartridge 23*a* in the third image formation section 23.

The image formation section chassis 25 has an eleventh edge 25*k* forming a projecting portion projecting upward in continuation from the tenth edge 25*j*.

A positioning pin 25*m* is provided in the top portion of the image formation section chassis 25 in the vicinity of the fifth edge 25*e*. The positioning pin 25*m* projects toward the front of the image forming apparatus. A positioning pin 25*n* is provided in a bottom portion of the image formation section chassis 25 in the vicinity of the seventh edge 25*g*. The positioning pin 25*n* also projects toward the front of the image forming apparatus.

The top portion of the dye fixing layer transfer section chassis 26 has a second edge 26*b* forming a projecting portion projecting downward in continuation from the first edge 26*a*. The projecting portion defined by the second edge 26*b* supports the dye fixing layer transfer head 44 of the dye fixing layer transfer section 40.

The dye fixing layer transfer section chassis 26 has a third edge 26*c* recessed substantially in a semi-circle in continuation from the second edge 26*b*. The substantially semi-circular portion defined by the third edge 26*c* accommodates the take-in roll 42 of the dye fixing layer transfer section 40.

The dye fixing layer transfer section chassis 26 has a fourth edge 26*d* forming a horizontally projecting portion in continuation from the third edge 26*c*. The projecting portion defined by the fourth edge 26*d* is continued to a fifth edge 26*e* which is vertical.

A positioning pin 26*m* is provided in the top portion of the dye fixing layer transfer section chassis 26 in the vicinity of the third edge 26*c*. The positioning pin 26*m* projects toward the front of the image forming apparatus. A positioning pin 26*n* is provided in a bottom portion of the dye fixing layer transfer section chassis 26 in the vicinity of the fifth edge 26*g*. The positioning pin 26*n* also projects toward the front of the image forming apparatus.

Figure 7:
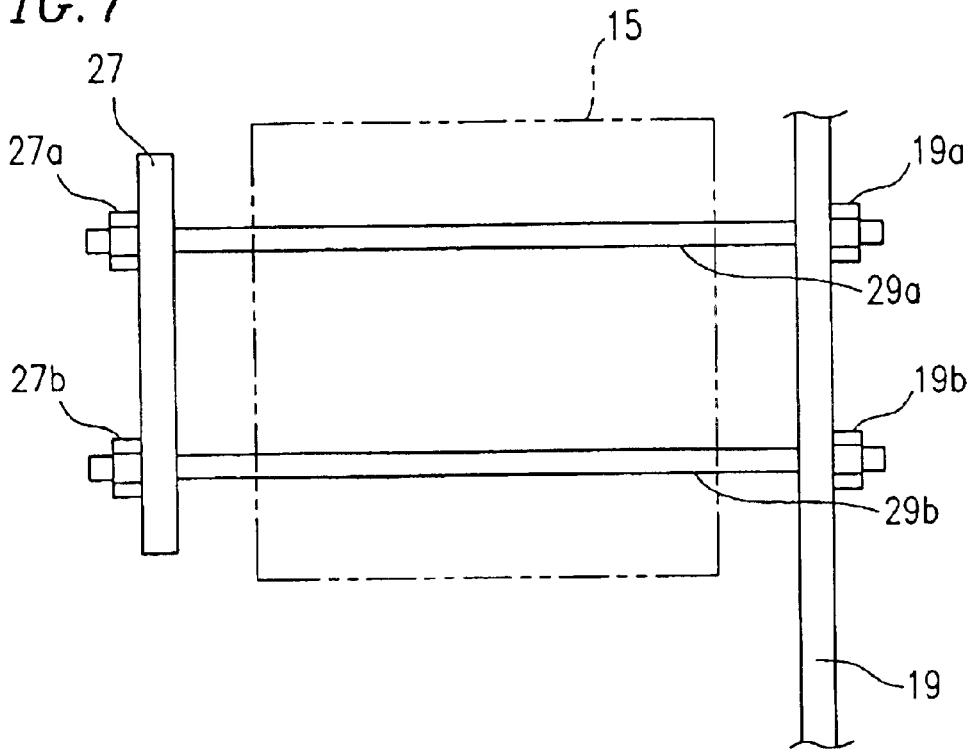
FIG. 7 is a schematic structural view of a platen drum chassis provided on the side of the image forming apparatus.

In the space formed in the central region between the image formation section chassis 25 and the dye fixing layer transfer section chassis 26, a platen drum chassis 27 is provided separately from the image formation section chassis 25 and the dye fixing layer transfer section chassis 26. FIG. 7 is a schematic side view of the platen drum chassis 27. The platen drum chassis 27 supports the platen drum 12, the sub drum 13 and the assisting driving roller 14 together with a rear chassis 19. An outer circumferential edge of the platen drum chassis 27 is substantially along the entirety of the traveling region of the recording intermediate belt 15 wrapped around the platen drum 12, the sub drum 13 and the assisting driving roller 14.

The platen drum chassis 27 is supported by the rear chassis 19 via a support rod 29*a* within the traveling region of the recording intermediate belt 15 which moves between the platen drum 12 and the sub drum 13. Within the traveling region of the recording intermediate belt 15 in the vicinity of the assisting driving roller 14 also, the platen drum chassis 27 is supported by the rear chassis 19 via a support rod 29*b*. A rear end of the support rod 29*a* and a rear end of the support rod 29*b* are attached to the rear chassis 19 respectively by nuts 19*a* and 19*b*. A front end of the support rod 29*a* and a front end of the support rod 29*b* are attached to the platen drum chassis 27 respectively by nuts 27*a* and 27*b*.

As shown in FIG. 6, a positioning pin 27*m* is provided in a side portion of the platen drum chassis 27 in the vicinity of the image formation section chassis 25. The positioning pin 27*m* projects toward the front of the image forming apparatus. A positioning pin 27*n* is provided in a portion of the platen drum chassis 27, at a position closer to the dye fixing layer transfer section chassis 26 from the central region thereof. The positioning pin 27*n* projects toward the front of the image forming apparatus.

Figure 8:
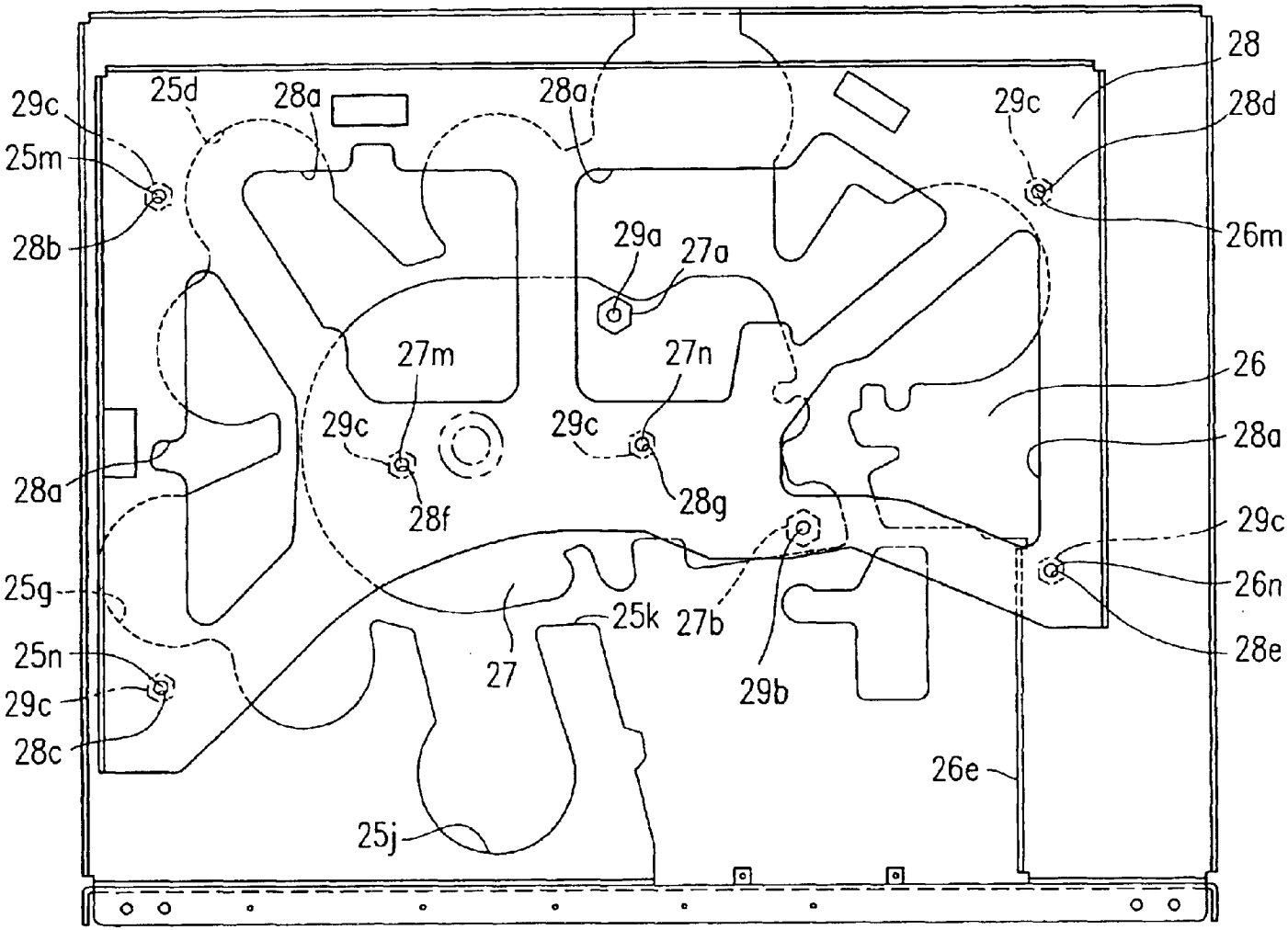
FIG. 8 is a front view illustrating a structure of a positioning plate attached to the chassis.

As shown in FIG. 8, the platen drum chassis 27 is positioned with respect to the image formation section chassis 25 and the dye fixing layer transfer section chassis 26 by a positioning plate 28 attached to the image formation section chassis 25 and the dye fixing layer transfer section chassis 26. The positioning plate 28 covers a front portion of the housing 11 except for the bottom portion thereof. The positioning plate 28 has openings 28*a* along two sides thereof . The positioning plate 28 further has a pair of openings 28*a* between the openings 28 along the two sides thereof.

The positioning plate 28 has a through-hole 28*b* formed in the vicinity of one top corner thereof. The positioning pin 25*m* provided in the top portion of the image formation section chassis 25 is to be inserted into the through-hole 28*b* when the positioning plate 28 is assembled with the image formation section chassis 25. The positioning plate 28 also has a through-hole 28*c* formed in the vicinity of one bottom corner thereof. The positioning pin 25*n* provided in the bottom portion of the image formation section chassis 25 is to be inserted into the through-hole 28*c*.

The positioning plate 28 has a through-hole 28*d* formed in the vicinity of the other top corner thereof. The positioning pin 26*m* provided in the top portion of the dye fixing layer transfer section chassis 26 is to be inserted into the through-hole 28*d* when the positioning plate 28 is assembled with the dye fixing layer transfer section chassis 26. The positioning plate 28 also has a through-hole 28*e* formed in the vicinity of the other bottom corner thereof. The positioning pin 26*n* provided in the bottom portion of the dye fixing layer transfer section chassis 26 is to be inserted into the through-hole 28*e*.

The positioning plate 28 has through-holes 28*f* and 28*g*. The positioning pins 27*m* and 27*n* provided on the platen drum chassis 27 are to be respectively inserted into the through-holes 28*f* and 28*g* when the positioning plate 28 is assembled with the platen drum chassis 27. The through-holes 28*f* and 28*g* are provided at lower central positions with an appropriate distance therebetween in the horizontal direction.

The positioning pins 25*m* and 25*n*, 26*m* and 26*n*, 27*m* and 27*n* respectively inserted into the through-holes 28*b* through 28*g* of the positioning plate 28 are thread-engaged. Thus, the platen drum chassis 27, the image formation section chassis 25 and the dye fixing layer transfer section chassis 26 are assembled while positioned with respect to each other.

Figure 9:
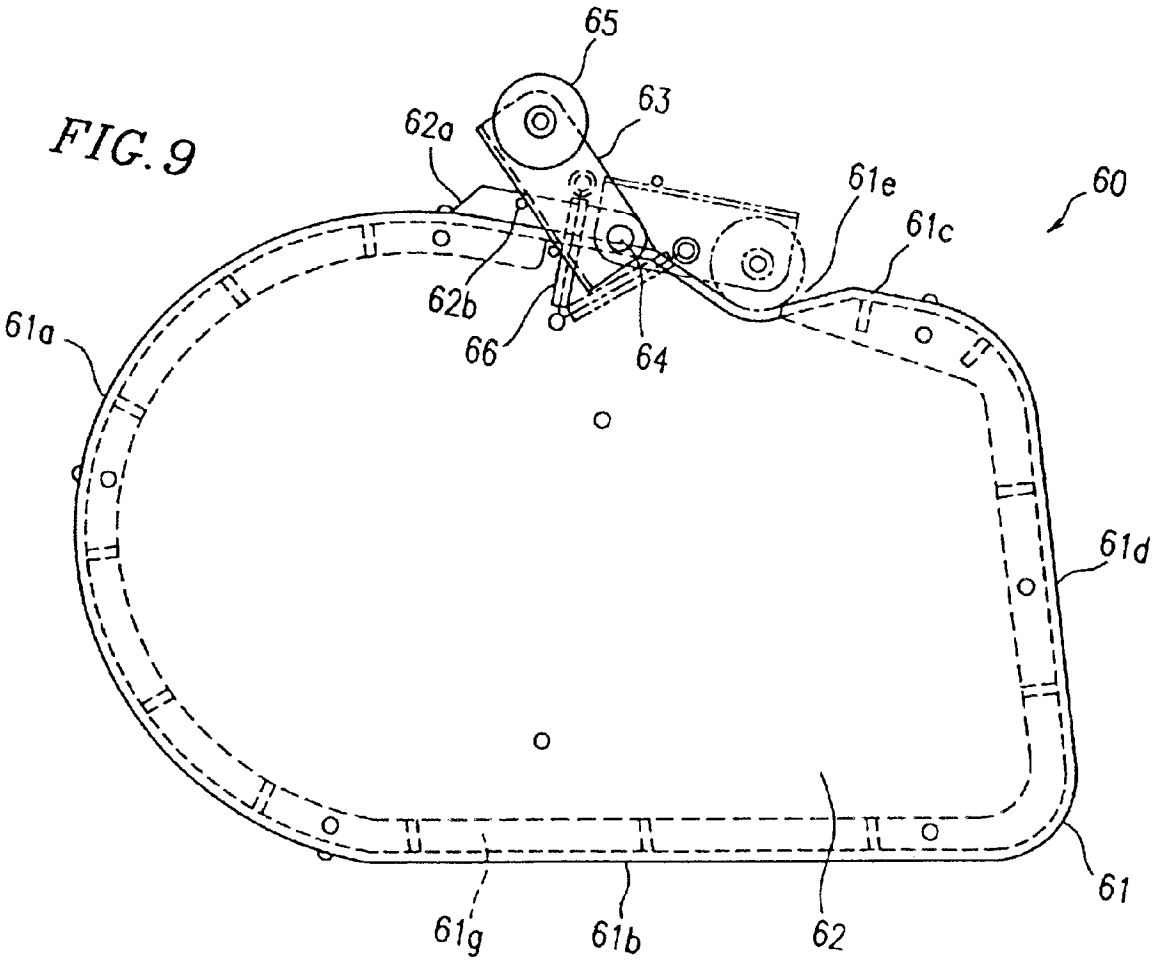
FIG. 9 is a front view illustrating an example of a belt mounting jig.
Figure 10:
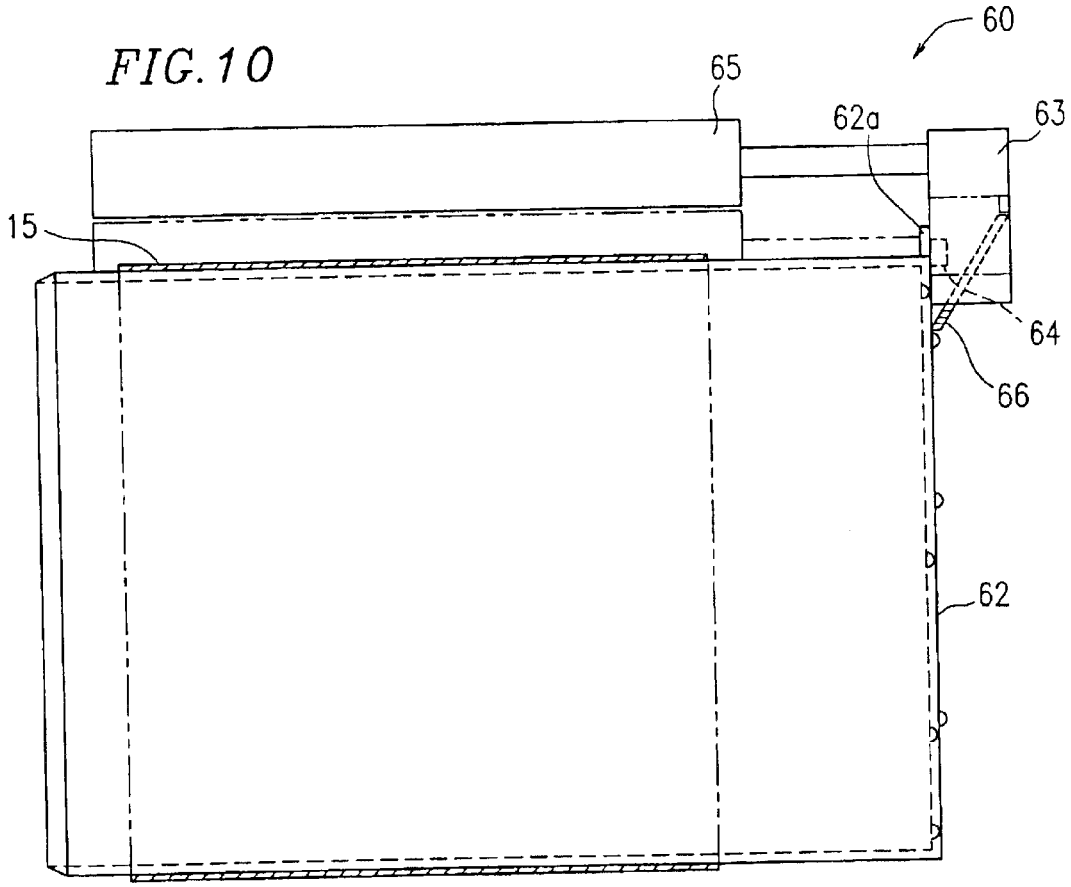
FIG. 10 is a side view of the belt mounting jig.

FIG. 9 is a front view of a belt mounting jig 60 which is used in such an image forming apparatus for replacing the recording intermediate belt 15 with a new recording intermediate belt 15. FIG. 10 is a side view thereof. The belt mounting jig 60 includes a cylindrical belt holder 61 for holding a new recording intermediate belt 15 which is to be mounted on the image forming apparatus. The outer circumferential edge of the cylindrical belt holder 61 is substantially along the outer profile of the traveling region of the recording intermediate belt 15, and can accommodate the outer circumferential edge of the platen drum chassis 27 for supporting the platen drum 12.

The outer circumferential edge of the belt holder 61 includes a semi-circular portion 61*a* along about a half of the circumferential surface of the platen drum 12 wrapped around by the recording intermediate belt 15. The outer circumferential edge of the belt holder 61 includes a flat bottom portion 61*b* in continuation from the semi-circular portion 61*a*. The bottom portion 61*b* is along the section of the recording intermediate belt 15 from the platen drum 12 toward the assisting driving roller 14. The outer circumferential edge of the belt holder 61 includes a substantially flat top portion 61c in continuation from the semi-circular portion 61*a*. The top portion 61*c* is along the section of the recording intermediate belt 15 from the sub drum 13 to the platen drum 12. The top portion 61*c* and the bottom portion 61*b* are coupled to each other by a side portion 61*d* which is tilted substantially along the section of the recording intermediate belt 15 from the assisting driving roller 14 to the sub drum 13.

The outer circumferential surface of the belt holder 61 including the semi-circular portion 61*a*, the bottom portion 61*b*, the side portion 61*d* and the top portion 61*c* are entirely constant and slightly wider than the width of the recording intermediate belt 15. The outer circumferential surface of the belt holder 61 has a length in the circumferential direction which is substantially equal to the length in the circumferential direction of the recording intermediate belt 15 which is mounted on the image forming apparatus.

The top portion 61*c* of the belt holder 61 has a recessed groove 61*e* which extends in the width direction of the recording intermediate belt 15 to be held. The groove 61*e* has a V-shaped cross-section; i.e., the size thereof along the traveling direction of the recording intermediate belt 15 gradually decreases. The bottom of the groove 61*e* is arc-shaped.

The belt holder 61 has a flange 61*g* in the entire circumference thereof on one end surface thereof. A side plate 62 for closing the end surface is fixed to the flange 61*g* so as to cover the space surrounded by the flange 61*g*. The other end surface of the belt holder 61 is opened.

The side plate 62 has a support section 62*a* projecting upward from the top portion 61*c* of the belt holder 61. The support section 62*a* is provided between the groove 61*e* and the semi-circular portion 61*a*. An end of the support section 62*a* in the vicinity of the groove 61*e* has a support shaft 64 which projects from the belt holder 61. The support shaft 64 has one end (base end) of a bracket 63 pivotably attached thereto. The bracket 63 has a U-shaped cross-section. The bracket 63 is pivotable about the base end thereof along the side plate 62.

The other end (tip end) of the bracket 63 supports a belt pressing roller 65 above the top portion 61*c* of the belt holder 61. The belt pressing roller 65 is supported while extending in the width direction of the top portion 61*c*. The belt pressing roller 65 can be engaged in the groove 61*e* of the top portion 61*c* by the pivoting of the bracket 63 (represented with a two-dot chain line in FIG. 9) or can be above the top portion 61*c* (represented with a solid line in FIG. 9) as a result of the bracket 63 pivoting upward at 120 degrees.

The bracket 63 has one end of a tension spring 66 attached thereto. The other end of the tension spring 66 is attached to an upper outer surface of the side plate 62 such that the tension spring 66 does not interfere the support shaft 64.

When the belt pressing roller 65 is engaged in the groove 61*e* of the top portion 61*c* by the pivoting of the bracket 63, the tension spring 66 pulls the bracket 63 downward so that the belt pressing roller 65 is in pressure contact with the arc-shaped bottom of the groove 61*e*. When the belt pressing roller 65 is moved to the retracted position above the top portion 61*c* by the pivoting of the bracket 63, the tension spring 66 exceeds dead center and pulls the bracket 63 downward. In this case, the belt pressing roller 65 is stopped by a stopper 62*b* provided on the support section 62*a* of the side plate 62, such that the belt pressing roller 65 is away from the top portion 61*c* by an appropriate distance.

Using the belt mounting jig 60 having the above-described structure, a new recording intermediate belt 15 is allowed to be wrapped around the platen drum 12, the sub drum 13 and the assisting driving roller 14 in the following manner. First, the positioning plate 28 in the front side of the housing 11 is detached as follows. After the positioning pins 25*m*, 25*n*, 26*m*, 26*n*, 27*m* and 27*n* attached to the chassis 25 through 27 and the nuts 29*c* threaded with the positioning pins are disengaged, the positioning plate 28 is slid toward the front side of the housing 11.

The deteriorated recording intermediate belt 15 is removed from the image forming apparatus as follows. While the tension roller 16 which applies tension to the recording intermediate belt 15 in the housing 11 is separated from the recording intermediate belt 15, the deteriorated recording intermediate belt 15 is removed from the platen drum 12, the sub drum 13 and the assisting driving roller 14.

The new recording intermediate belt 15 is attached to the belt mounting jig 60. In this case, the bracket 63 of the belt mounting jig 60 is pivoted so as to move the belt pressing roller 65 to the retracted position, which is above and an appropriate distance away from the top portion 61*c* of the belt holder 61. The new recording intermediate belt 15 is engaged with the outer circumferential surface of the belt holder 61. Thus, the new recording intermediate belt 15 is along the outer circumferential surface of the belt holder 61.

The recording intermediate belt 15 has a circumferential length which is substantially equal to that of the outer circumferential surface of the belt holder 61. In the case where the recording intermediate belt 15 is not along the arc-shaped bottom of the groove 61*e* provided in the outer circumferential surface of the top portion 61*c* of the belt holder 61, the recording intermediate belt 15 is mildly engaged with the belt holder 61.

In this state, the bracket 63 is pivoted such that the belt pressing roller 65 is engaged with the groove 61*e* formed in the top portion 61*c* of the belt holder 61. Thus, the tension spring 66 exceeds the dead center and pulls the bracket 63 downward such that the belt pressing roller 65 is engaged with the groove 61*e*. When the bracket 63 is pulled downward by the tension spring 66, the belt pressing roller 65 supported by the bracket 63 places a portion of the recording intermediate belt 15, engaged with the belt holder 61, in the groove 61*e* and presses the portion toward the inner surface of the groove 61*e*. In this state, the recording intermediate belt 15 engaged with the outer circumferential surface of the belt holder 61 is tightly contacted on the entire outer circumferential surface of the belt holder 61 and thus integrated with the belt holder 61.

Figure 11:
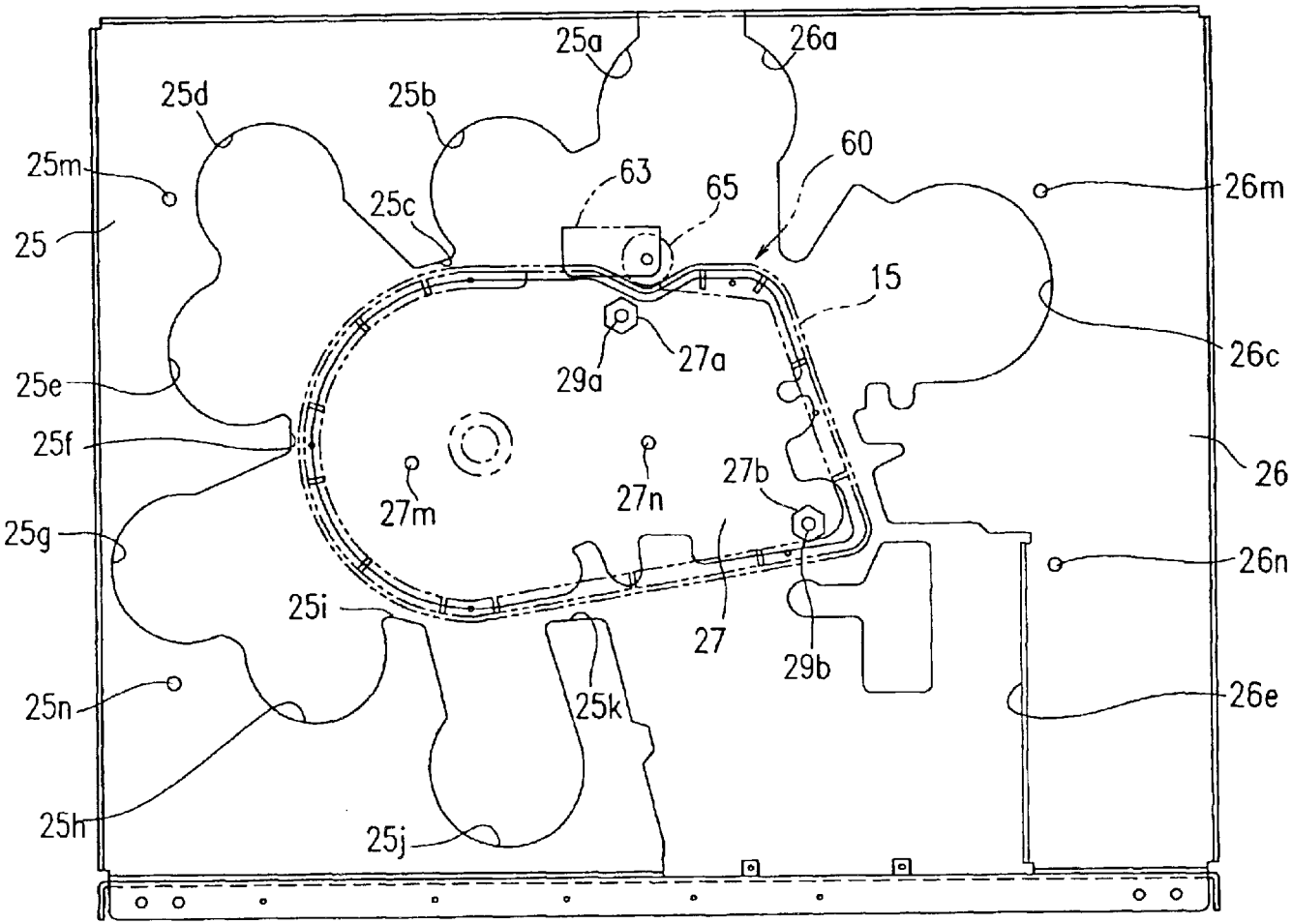
FIG. 11 is a schematic front view illustrating the state where the recording intermediate belt is mounted on the image forming apparatus using the belt mounting jig.

As described above, the recording intermediate belt 15 is tightly contacted on the outer circumferential surface of the belt holder 61 to the point of being integrated with the belt holder 61. Then, as shown in FIG. 11, the belt mounting jig 60 is located such that the opened end surface thereof (the side plate 62 being on the front side) faces the platen drum chassis 27 for supporting the platen drum 12. The belt holder 61 is inserted into the housing 11 such that the platen drum chassis 27 fits inside the belt holder 61 while engaged with the outer circumference of the belt holder 61.

When the belt holder 61 is entirely in the housing 11, the bracket 63 is pivoted so as to move the belt pressing roller 65 above the groove 61*e* formed in the top portion 61*c* of the belt holder 61. Thus, the tension spring 66 exceeds the dead center and pulls the bracket 63 to the retracted position where the bracket 63 is in contact with the stopper 62*b*. The belt pressing roller 65 is at the retracted position which is an appropriate distance away from the top portion 61*c*.

In this state, the belt mounting jig 60 is entirely slid toward the front of the image forming apparatus so as to be discharged from the housing 11. The recording intermediate belt 15 engaged with the belt holder 61 is prevented from sliding together with the belt holder 61 so as to be kept inside the housing 11. When the belt mounting jig 60 is completely outside the housing 11, the recording intermediate belt 15 is in the state of being wrapped around the platen drum 12, the sub drum 13 and the assisting driving roller 14. After this, the tension roller 16 is pressure-contacted on the recording intermediate belt 15 wrapped around the platen drum 12, the sub drum 13 and the assisting driving roller 14, so as to apply tension to the recording intermediate belt 15. Thus, the recording intermediate belt 15 is in a prescribed mounting state with respect to the image forming apparatus.

When the recording intermediate belt 15 is mounted in the image forming apparatus, the positioning plate 28 is located on the front side of the housing 11. The positioning pins 25*m*, 25*n*, 26*m*, 26*n*, 27*m* and 27*n* attached to the chassis 25 through 27 are respectively inserted into the through-holes 28*b* through 28*g*. In this state, the nuts 29*c* are thread-engaged with the positioning pins 25*m*, 25*n*, 26*m*, 26*n*, 27*m* and 27*n*.

In this manner, the chassis 25 through 27 are positioned with respect to each other by the positioning plate 28. As a result, the platen drum 12 supported by the platen drum chassis 27 is positioned with respect to the first through third image formation sections 21 through 23 attached to the image formation section chassis 25 with high precision. In addition, the platen drum chassis 27 supported to the rear chassis 19 by the rods 29*a* and 29*b* is assembled with, and integrated with, the image formation section chassis 25 and the dye fixing layer transfer section chassis 26, which are attached to the housing 11 via the positioning plate 28. Owing to such a structure, the platen drum chassis 27 is reinforced by the positioning plate 28. The platen drum 12 supported by the platen drum chassis 27 has no undesirable possibility of being positionally offset.

INDUSTRIAL APPLICABILITY

In an image forming apparatus according to the present invention, as described above, the recording head of each image formation section is pressed onto a non-image formation area of a recording intermediate belt and thus starts an image formation operation. The recording head stops the image formation operation while facing a non-image formation area of the recording intermediate belt, and is separated from the recording intermediate belt. Accordingly, the image formation operation is not adversely influenced by a load fluctuation caused by a recording head being pressed onto the recording intermediate belt while another recording head is forming an image, or by a load fluctuation or the like caused when the image formation operation of the recording head is started and stopped. As a result, an image formed in each image formation area is free of color non-uniformity or the like, and thus a clear full-color image can be formed.

The recording intermediate belt is driven to travel around a continuous path at a constant speed by a platen drum located so as to face each image formation section and is supplied with a constant torque by an assisting driving roller. Owing to such a structure, the tension applied on the recording intermediate belt is decreased, which allows the recording intermediate belt to be used stably in a long period of time.

The roller wrapped around by the recording intermediate belt is tilted with respect to a direction perpendicular to the traveling direction of the recording intermediate belt. Therefore, one side edge of the recording intermediate belt is always within a prescribed region, which prevents the recording intermediate belt from meandering.

A recording paper peeled off from the recording intermediate belt is pressure-contacted on the peeling roller at a peeling position in a straight manner along the direction of the axis of the peeling roller. This makes clear the peeling position at which the recording paper is peeled off from the recording intermediate belt and improves the level of performance of peeling off the recording paper from the recording intermediate belt. Since the peeling roller is pressure-contacted on the recording paper, the load fluctuation caused to the recording paper when the recording paper is cut by a cutter is not conveyed to the recording intermediate belt.

In the image forming apparatus according to the present invention, a platen drum chassis provided on the front side for supporting the platen drum is separated from an image formation section chassis provided on the front side for supporting the image formation sections, such that the recording intermediate belt wrapped around the platen drum is easily replaced. The platen drum chassis and the image formation section chassis are positioned with respect to each other by a positioning plate with high precision. Therefore, the recording head of each image formation section and the platen drum can be positioned with respect to each other with high precision. Since the platen drum chassis independently provided is reinforced by the positioning plate, the platen drum has no undesirable possibility of being positionally offset.

A belt mounting jig according to the present invention allows the recording intermediate belt to be easily mounted on the image forming apparatus having the above-described structure.

What is claimed is:

1. An image forming apparatus, comprising:

a recording intermediate belt which is made endless so as to travel around a continuous path and has image formation areas and non-image formation areas alternately provided on an outer surface thereof;

a plurality of image formation sections located so as to sequentially face the image formation areas on the traveling recording intermediate belt, the plurality of image formation sections each including a recording head for performing an image formation operation based on an image signal while being pressed onto the recording intermediate belt; and an image transfer section for transferring an image formed by each of the image formation sections onto a recording paper, wherein the recording heads of the image formation sections are separated from each other by a distance which is greater than a length of each image formation area on the recording intermediate belt in a traveling direction of the recording intermediate belt.

2. An image forming apparatus according to claim 1, wherein when one of the recording heads of the image forming sections faces a non-image formation area on the recording intermediate belt, all the other recording heads respectively face non-image formation areas.

3. An image forming apparatus according to claim 2, wherein each of the recording heads of the image formation sections is pressed onto the recording intermediate belt and starts an image formation operation in the state of facing the non-image formation area of the recording intermediate belt.

4. An image forming apparatus according to claim 1, wherein the image transfer section includes a transfer head for transferring an image on the recording intermediate belt onto the recording paper, and the transfer head is separated from the recording head of the image formation section which is closest to the image transfer section by a distance which is greater than a length of each image formation area on the recording intermediate belt in a traveling direction of the recording intermediate belt.

* * * * *